US005788540A

United States Patent [19]

Schekalla et al.

[11] Patent Number: 5,788,540

[45] Date of Patent: Aug. 4, 1998

[54] ELECTRICAL CONNECTING PART OF A TWO PART PLUG AND SOCKET CONNECTION

[75] Inventors: Peter Schekalla; Jan Svendsen; Roman Seutschniker, all of Wuppertal, Germany

[73] Assignee: Delphi Automotive Systems Deutschland GmbH, Wuppertal, Germany

[21] Appl. No.: 936,360

[22] Filed: Sep. 24, 1997

Related U.S. Application Data

[63] Continuation of Ser. No. 666,531, Jul. 2, 1996, abandoned.

[30] Foreign Application Priority Data

Nov. 4, 1994 [DE] Germany ..... 44 39 386.5

[51] Int. Cl.[6] ..... H01R 13/514

[52] U.S. Cl. ..... 439/752

[58] Field of Search ..... 439/752, 595

[56] References Cited

U.S. PATENT DOCUMENTS

| | | | |
|---|---|---|---|
| 4,806,123 | 2/1989 | Konishi et al. | 439/595 |
| 5,033,980 | 7/1991 | Watanabe et al. | 439/752 |
| 5,085,599 | 2/1992 | Maejima et al. | 439/595 |
| 5,108,309 | 4/1992 | Oda et al. | 439/595 |
| 5,224,883 | 7/1993 | Yamamoto | 439/752 |

*Primary Examiner*—Neil Abrams
*Assistant Examiner*—T. C. Patel
*Attorney, Agent, or Firm*—Cary W. Brooks

[57] ABSTRACT

The invention relates to a connecting part of a two-part plug-and-socket connection, the housing of which has at least two axial housing chambers lying next to each other in pairs, between which there is an axial partition. The housing chambers serve respectively to receive electrical contact parts, which, in their defined end position, extend as far as a coupling portion of the housing, which can be plugged-in with a complementary coupling portion of the other connecting part forming part of the plug-and-socket connection. In order to obtain a space-saving connecting part in which a slide displaying blocking elements locks the inserted contact parts in their end position within the housing chambers, it is proposed to configure the slide from a detachable segment of the axial partition and to configure the blocking elements for the locking from radial projections on this partition element. The housing possesses between its two housing chambers an axial recess for axial plug-in fitting of this partition segment, which recess is open in the direction of the coupling portion of the housing.

6 Claims, 3 Drawing Sheets

ELECTRICAL CONNECTING PART OF A TWO PART PLUG AND SOCKET CONNECTION

This is a continuation of application Ser. No. 08666531 filed on 02 Jul. 1996 now abandoned.

The invention relates to one or both connecting parts of a two-part, electrical plug-and-socket connection, the connecting parts of which have two mutually complementary housings. The one housing receives electrical contact parts, such as socket contacts, and is provided with a plug-in portion which can be plugged into a receiving portion of the other housing in the coupling situation. Because of its plug-in function, this housing of the plug-and-socket connection shall be described in short as the "plug housing". The other housing which is assigned thereto possesses a complementary receiving space for the plug-in portion of the plug housing, for which reason it shall hereinafter be abbreviated to the "socket housing". In the coupling situation, the plug housing engages with its plug-in portion in the receiving portion of the socket housing, for which reason these join-together ends of the two connecting parts shall hereinafter be described in short as the "coupling ends". The socket housing serves to receive electrical mating-contact parts, e.g. in the form of plug contacts. For the contact and mating-contact parts respectively, the associated housing possesses at least two axial housing chambers lying next to each other in pairs, into which the contact and mating-contact parts connected to a respective electric lead are inserted from the side facing away from the coupling end of the housing. The axial partition between the housing chambers has the task of insulating the two contact parts one from the other. In a plug-and-socket connection of this type, in the coupling situation the engaged contact and mating-contact parts are outwardly well covered at least by the casing of the receiving portion of the socket housing, thereby preventing either dirt or spraywater from adversely affecting the electrical contacting.

The housing of the known plug-and-socket connection can produce sealing problems deriving from locking means for the contact parts in the housing chambers. In one known plug-and-socket connections, a bolt having profiled apertures is used for locking purposes, which bolt is displaceable transversely to the housing chambers and can be latch-locked in two settings within the housing. In a first latch setting, which shall be described as the "preliminary latch setting", the aperture profile of the bolt is matched to the apertural cross-section of the housing chambers and allows the aforementioned axial insertion of the contact parts. In the second latch setting, which shall hereinafter be referred to as the "end latch setting", the bolt travels with its aperture profile with blocking effect into the housing chambers and back-grips radial shoulders located on the contact parts. In the end latch setting, the mating-contact parts are fixed in the housing chambers, whereby they are prevented from any longer withdrawing from the housing chambers in opposite direction to their insertion motion.

This known locking of the contact parts in a defined axial position within the housing chambers has in any event, however, associated drawbacks. Both for the arrangement of the bolt and for its reversal between its two latch settings, an appropriate spatial requirement is necessary within the respective housing. If the reversal motion of the bolt between its latch settings is performed from the outer side of the socket housing, then the aforementioned sealing problems arise. If an attempt is made to shift the reversal of the bolt between its two latch settings to inside the housing, then an additional spatial requirement is necessary either for jointly movable handles located on the bolt or for channels for the insertion of external actuating tools. In order to be able to fit the known bolt inside the housing, one is finally faced with the drawback of a multi-part configuration of the socket housing. The manufacture of a multi-part housing is expensive and requires a time-consuming, step-by-step fitting of the housing parts to enable the bolt to be arranged between the housing parts.

The object of the invention is to develop a cheap, electrical plug-and-socket connection which is outwardly well shielded, of the type stated in the preamble of claim 1, and which allows a comfortable, reliable reversal motion of a slide which locks the mating-contact parts in the female part and yet is configured such that it is sparing of parts and saves space. This is achieved according to the invention by virtue of the measures which are quoted in the defining clause of claim 1 and to which the following particular importance is attached.

In the invention, the axial partition between the two housing chambers acquires the additional, new function, namely to serve as a slide for the locking of the inserted contact parts. The space for an additional slide is thereby saved. It is sufficient for the invention if that segment of the axial partition which extends as far as the radial shoulders, serving as locking points, of the contact parts inserted in the housing chambers is made detachable. This detachable segment of the axial partition shall hereinafter be abbreviated to the "partition piece". The partition piece possesses radial projections as blocking elements for the contact parts.

An ideal, spraywater-protected position of this partition piece is already ensured, since it lies naturally between the two housing chambers, i.e. in the axial region, in the middle of the socket housing. It is nevertheless easy to handle, since an axial recess which emanates, for example, from the receiving space inside the socket housing and is situated between the two housing chambers can be used for this purpose. Apart from this partition piece, the whole of the housing can be configured in one piece, thereby eliminating the costly manufacture of a plurality of housing parts and their time-consuming assembly. The partition piece can be slid from the coupling end of the housing, by simple plug-in fitting, into the axial recess down to the definitive maximum depth. In the subsequent locking operation, the axial recess simultaneously serves as a guide for the partition piece. The partition piece is namely displaced parallel to the wall on the inner faces of the recess and the recess needs only have a recess height which is sufficient for this purpose. If the partition piece has been plugged axially into the axial recess, it is then moved perpendicularly thereto so as to be displaced beyond the preliminary latch setting as far as its end latch setting.

The recess advantageously possesses an aperture profile, the bordering wall parts of which, even in the preliminary latch setting of the partition piece, cover the radial projections of the latter, at least in some areas, in the direction of the receiving space. The housing, together with the partition piece which is fixed in its preliminary latch setting, forms in this case a prefabricated structural unit made up of captive, positionally secured parts, which can be delivered in this form as a commercial product. In this preliminary latch setting of the partition piece, its radial projections do not yet constrict the clear cross-section of the housing chambers, thereby enabling the purchasers of these structural units to insert the contact parts comfortably into the housing themselves. The purchasers are themselves able individually to determine the type and form of the contact parts and of the electric leads connected thereto. In order to secure the defined axial position of the contact parts in the housing chambers, the purchasers have only to displace the partition piece, from the coupling end, e.g. from the receiving space, further in the transverse direction, until the end latch setting of the partition piece takes effect. Only then do the radial projections of the partition piece grip with locking effect behind the radial shoulders of the inserted contact parts.

Further measures and advantages of the invention derive from the following description and the drawings. The invention is represented in an illustrative embodiment in the drawings, in which.

Figure 2:
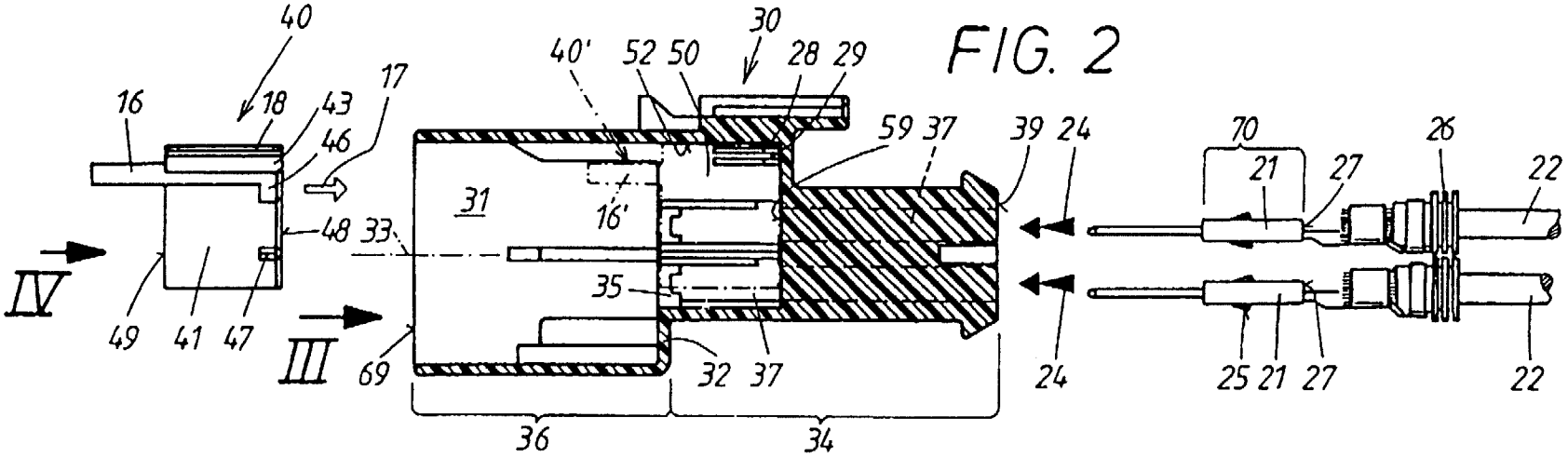
FIG. 2 shows, in exploded representation, the component parts of the one connecting part of FIG. 1 which has a socket housing, in which the socket housing is represented in axial section along the sectional line II—II of FIG. 3 in a longitudinal plane which is staggered relative to the half-section of FIG. 1.
Figure 5:
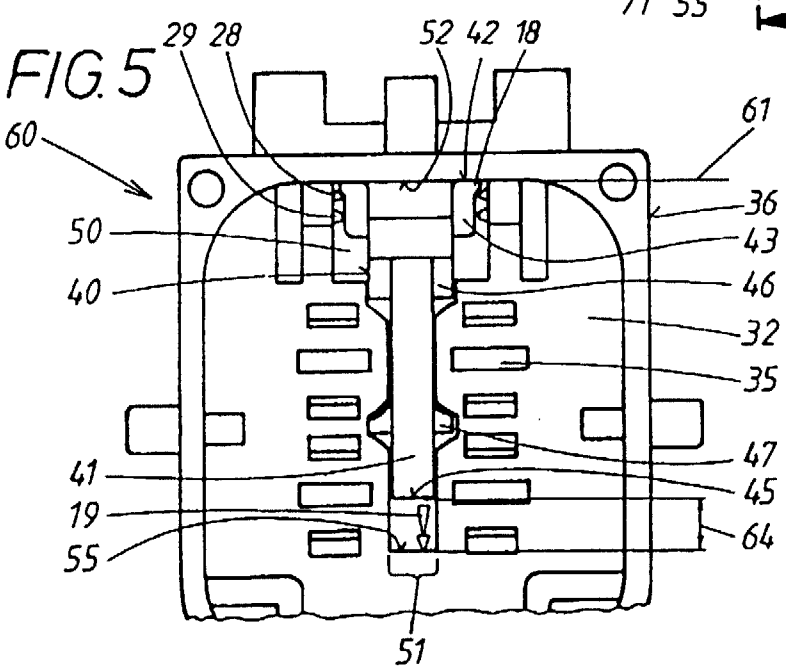
FIG. 5 shows, in a further enlargement relative to FIGS. 3 and 4, the front view of the connecting part of FIG. 2, where the partition piece is in a "plug-in fitting setting" in the socket housing.
Figure 9:
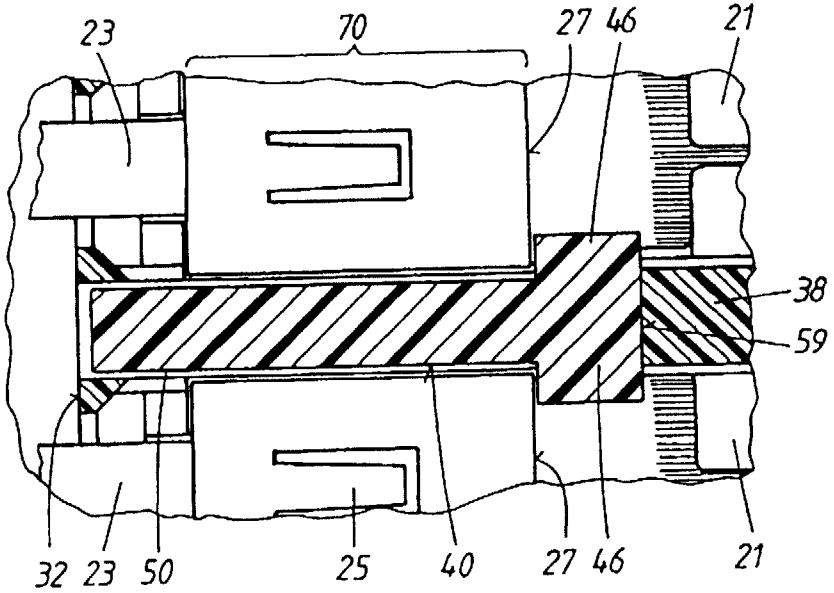
Figure 7:
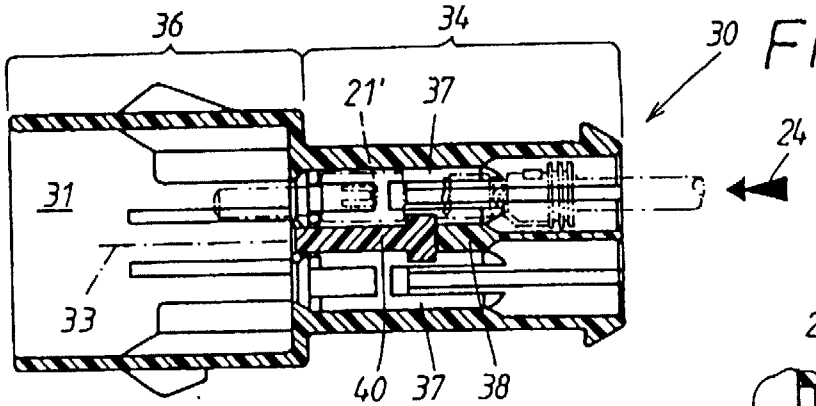
FIG. 7 shows, in a representation which is reduced in size relative to FIG. 6, a horizontal section through the two pre-fitted component parts of FIG. 6 along the horizontal sectional plane VII—VII which is there present.

FIG. 8 shows, again in a front view consistent with FIG. 5, the finished connecting part of FIG. 2 made of the three component parts shown in FIG. 2, when the partition is in its "end latch setting", and finally FIG. 9 shows, in a horizontal section consistent with FIG. 7 yet greatly enlarged relative thereto, a central region of the finished connecting part of FIG. 8 along the sectional line IX—IX which is there present.

Figure 1:
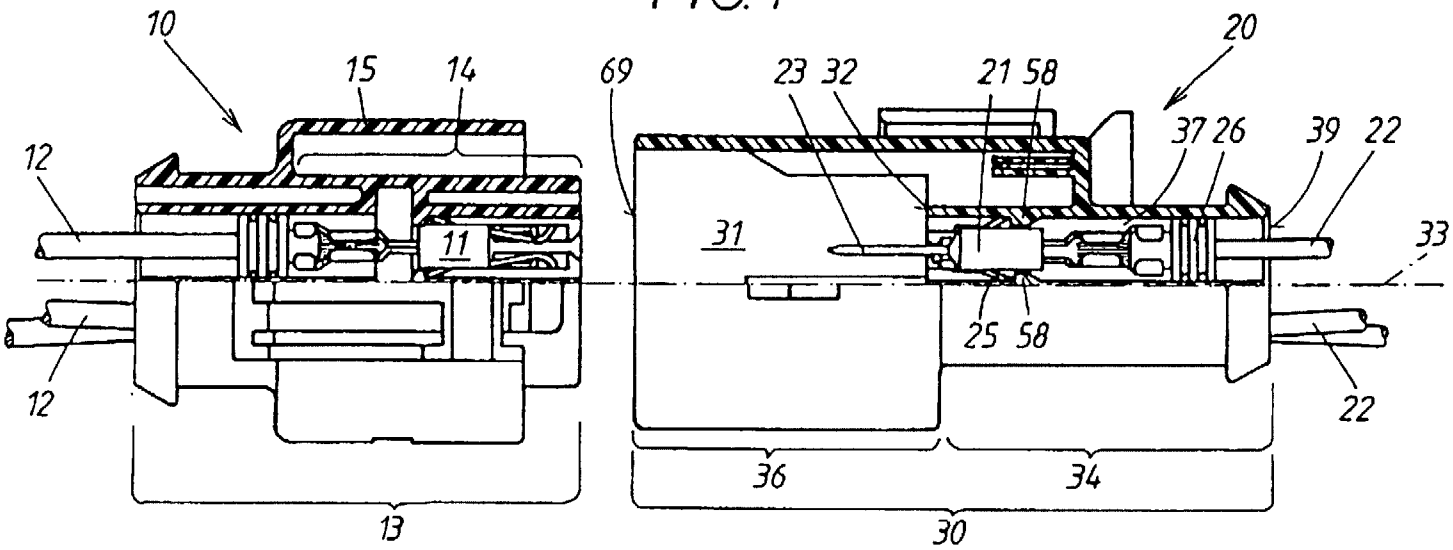
FIG. 1 shows, in a half longitudinal section, the two mutually decoupled connecting parts of the electrical plug-and-socket connection according to the invention following their completion, the sectional passage being illustrated, with reference to the one connecting part involving a socket housing, by the skewed sectional line I—I of FIG. 8.

The electrical connection comprises two connecting parts 10,20 which can be coupled together and which, as FIG. 1 shows, are mutually complementary in design, both in terms of their dual-sided electrical contact parts 11,21 and in terms of the coupling portions 14,39 of their housings 13,30, which coupling portions have to be fitted one inside the other. Each contact part and mating-contact part 11,21 is connected by a crimp connection or the like to the conductor of an associated electric lead 12 and 22 respectively, which are intended to be electrically joined together in pairs when the two connecting parts 10,20 are coupled. The housing 13 of the one connecting part 10 possesses, as coupling portion, a plug-in portion 14, to which there is assigned, in the housing 30 of the other connecting part 20, a receiving portion 36 having a correspondingly profiled receiving space 31. Because of its plug-in function by virtue of the plug-in portion 14, the housing of the first connecting part 10 shall hereinafter be described in short as the "plug housing", whilst that of the second connecting part 20, because of the socket-like receiving portion 36 which is there present, shall be described in short as the "socket housing".

Advantageously, the contact part in the plug housing 13 comprises a socket contact 11, whilst the mating-contact parts 21 in the socket housing 30 are configured as plug contact parts 21, which jut with a pin end 23 into the receiving space 31 which is there present. The receiving space 31 is axially delimited relative to the end portion 34 of the socket housing 30 by a base wall 32 running transversely to the longitudinal axis 33 of the housing 30 of FIG. 1. The appearance of the base wall 32 is evident from the front view of the socket housing in FIG. 3, where openings 35 are discernible for the passage of the plug pins 23. The housing 30 is divided by the base wall 32 into the wide coupling portion 36 and a rear portion 34. This rear portion 34 of the socket housing 30 is radially offset relative to the preceding front portion 36. As has already been mentioned, when the two connecting parts 10,20 are coupled, the plug housing 13 engages with its plug-in portion 14 in the receiving space 31 of the socket housing 30. For improved sealing, the plug housing 13 can possess a casing 15, discernible from FIG. 1, which encloses the plug-in portion 14 at a radial distance apart. Between the casing 15 and the plug-in portion 14, an annular space is formed, into which the receiving portion 36 of the socket housing 30 of the other connecting part 20 can penetrate. In the coupling situation, when the plug pins 23 of the mating-contact parts 21 engage in the socket contacts 11 of the plug housing 13, the electrical contact points are outwardly shielded on all sides. Where necessary, rubber seals can also be used between the housings 13,30. For the securement of the coupling engagement, the housings 13,30 of the two connecting parts 10,20 can also be mechanically joined together by snap connections or fastenings.

Figure 6:
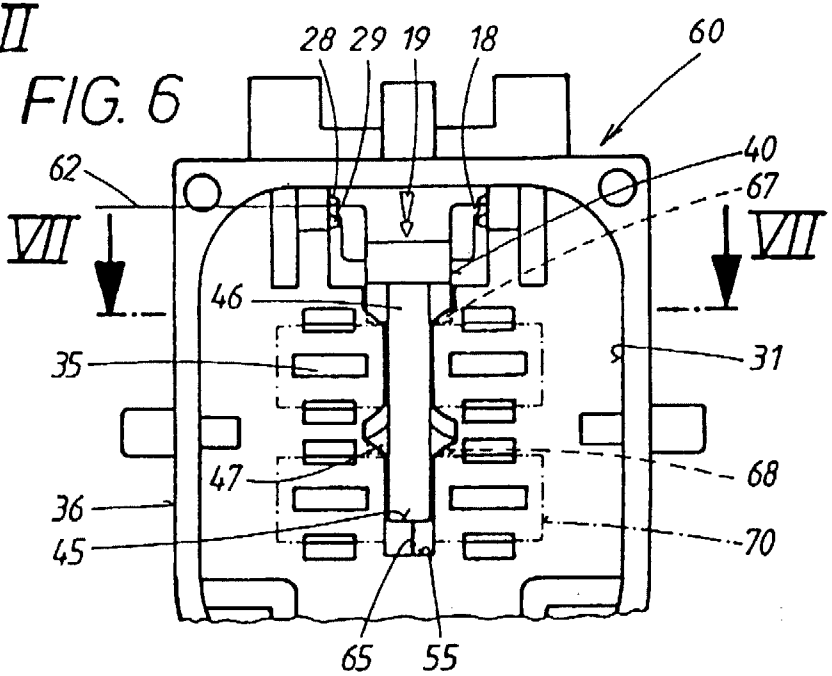
FIG. 6 shows, in a representation consistent with FIGS. 5, a "preliminary latch setting" of these two component parts of the connecting part of FIG. 2.

In the case of the invention, a special configuration of the connecting part 20 is provided, which, as can be seen from the exploded representation of FIG. 2, comprises apart from the mating-contact parts 21 just two further component parts, namely the aforementioned one-piece socket housing 30 and a specially designed slide 40, which, as is apparent from FIG. 7, fulfills the function of an insulating partition 38 within the socket housing 30. The partition 38 separates namely, in the rear portion 34, two axial housing chambers 37 lying next to each other in parallel, which are respectively used to insert the mating-contact parts 21. The bores in the housing chambers 37 are axially stepped. In the present case, as illustrated by the axial section of FIG. 2, two pairs of such housing chambers 37 are disposed such that they are situated one above the other, for which reason this connecting part 20, as is apparent from the front view of the ready-fitted connecting part 20 of FIG. 6, is a four-pole connecting part 20 provided with four pin ends 23.

As is apparent from FIG. 2, the mating-contact parts 21 are inserted axially into the associated housing chambers 37 from that rear end 39 of the housing 30 which faces away from the coupling end 69, as can be seen from the two insertion arrows 24 which are there present. As has already been mentioned, the slide 40, as is apparent from FIG. 7, has the function of a partition 38, in whose extension it is ultimately disposed. The slide 40, however, is made separately from the one-piece housing 30, forms therefore a "detachable segment" of the partition, which partition it extends, according to FIGS. 7 and 9, axially as far as the base wall 32 in the socket housing 30. Because of this special function, the slide 40 shall therefore hereinafter be described in short as the "partition piece". As is apparent from FIGS. 2 and 4, this partition piece 40 possesses a special axial and radial profile. Matched to this profile of the partition piece 40, the socket housing 30 possesses an axial recess 50 running in the inner region between the two housing chambers 37.

The partition piece 40 is firstly divided into a flat wall part 41, which possesses on its upper longitudinal margin 42 a U-shaped guide rail 43 which is widened relative to the thickness of the wall part 41.

Figure 4:
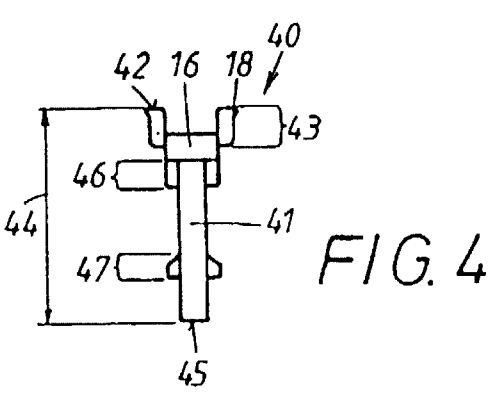
FIG. 4 shows, in an enlargement corresponding to FIG. 3, the front view of a second component part, shown in FIG. 2, of the connecting part which is there present, namely a detachable partition piece, in the direction of view of the arrow IV which is there present.
Figure 3:
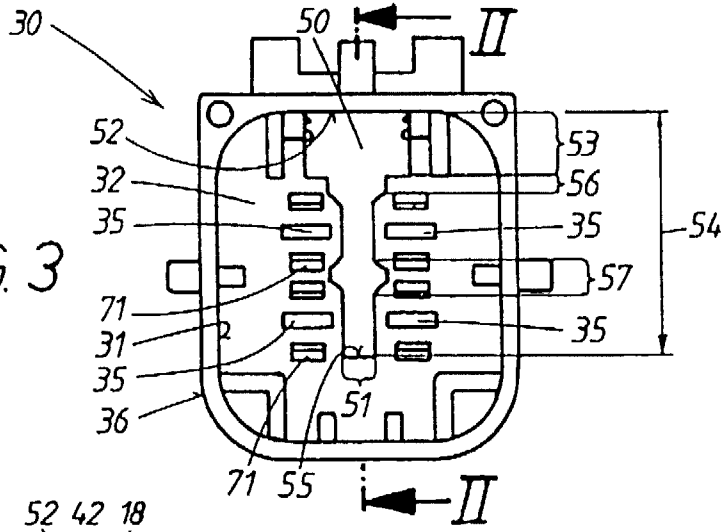
FIG. 3 shows, in a representation which is enlarged relative to FIG. 2, the front view of the socket housing in the direction of view of the arrow III of FIG. 2.

The aperture profile of the associated axial recess 50 accordingly comprises, as is evident from the front view of FIG. 3, a vertical slot 51 which is matched to the thickness of the wall part 41 of the partition piece 40 and which determines that the axial recess 50 should have a height 54 greater than that height 44 of the partition piece 40 which is discernible from FIG. 4. As is apparent from FIG. 3, the axial recess 50 possesses at its upper slot end 52 a channel-shaped expansion 53 corresponding to the contour of the guide rail 43.

According to FIG. 2, the wall part 41 is provided with a widened, yet axially running control pin 45, which extends beyond the outer edge 49 of the wall face 41 and, in the usage situation, fulfills a control function which is yet to be more closely described in conclusion. On the opposing inner edge 48, the partition piece 40 possesses two radial projections 46,47 disposed at a vertical distance apart, corresponding to the vertical spacing of the two aforementioned pairs of housing chambers 37 situated one above the other. As a comparison between FIGS. 4 and 3 make clear, the axial recess 50 possesses in these regions correspondingly widened, axial channel parts 56,57. This permits the following assembly of the socket housing 30 with the partition piece 40, which assembly is discernible from FIGS. 2 and 5.

In FIG. 5, a "plug-in fitting setting" of the partition piece 40 obtains, which setting is determined by the height-level line 61 in FIG. 5. This height-level line 61 shall be determined by the respective setting of the upper longitudinal margin 42 of the partition piece 40. In the setting which is discernible from FIG. 5, this longitudinal margin 42 of the partition piece bears slidably against the upper slot end 52 of the axial recess 50 on the housing side, which axial recess serves as a guide face whenever the partition piece 40 is inserted from inside the receiving space 31 of the socket housing 30, in the direction of the plug-in arrow 17 visible from FIG. 2, into the axial recess 50. As is apparent from FIG. 2, the upper slot end 52 namely finds an axial extension on the inner face of the receiving portion 36. An axial plug-in fitting of the partition piece 40 in the axial recess 50 is possible for the following reason.

As is apparent from FIG. 5, the radial projections 46,47 are situated in the aperture profile of the previously described, widened channel parts 46,47, in the same way as the broadened guide rail 43 of the partition piece 40 is situated in the channel-shaped expansion 53 visible from FIG. 3. The vertical slot 51 forms, together with the expansions and widenings 53,56,57, a plug-in channel, which extends as far as the recess floor 59 of the axial recess 50, which recess floor is discernible from FIG. 2, but also from FIG. 9. As is apparent from FIG. 9, the housing-fixed partition 38 begins behind this recess floor 59. The plug-in fitting 17 of the detachable partition piece 40 is terminated once its inner edge 48 comes to bear against the recess floor 59. This plug-in position of the partition piece 40' is illustrated in dash-dot representation in FIG. 2. As can be seen at 16' in FIG. 2, in this plug-in position the control pin juts into the receiving space 31.

That previously described vertical setting 61 of the partition piece 40 which is discernible from FIG. 5 can also be supported by latch fixtures. For instance, the partition piece 40 possesses latch fastenings 18, which, as is apparent from FIGS. 2 and 4, are disposed in the present case radially on both sides of the guide rail 43 and respectively comprise a latch boss. Two ribs 28,29, which determine latch depressions alongside them, serve as associated latch counter-fastenings. These latch depressions define, by means of the latch boss 18, the respective vertical position of the partition piece 40 in the axial recess 50. The two latch ribs 28,29 are molded onto the rear inner face of the channel-shaped expansion 53 in the socket housing 30. The aforementioned "plug-in fitting setting" of the partition piece 40 derives from the fact that the latch boss 18 which is there present is disposed above the first latch rib 28.

From this setting shown in FIG. 5, the partition piece 40 can now be displaced parallel to its axial wall part 41 in the direction of the transverse-motion arrow 19 visible from FIG. 5. The axial recess 50 here serves as a guide for the partition piece. This is possible because of the lesser height 44 of the partition piece 40 relative to the axial recess height 54 discernible from FIG. 3. The lower longitudinal margin 45 discernible from FIG. 5 is located at a large vertical spacing 64 from the corresponding lower slot end 55 of the axial recess 50. The transverse displacement 19 of the partition piece 40 expediently occurs fully automatically. This is handled by a fitting tool, which has already executed the axial plug-in motion 17 beforehand. This tool performs a defined displacement in the direction of the transverse-motion arrow 19 of FIG. 6, which displacement leads to deformation of the interacting latch fastenings and counter-fastenings 18,28 respectively. As shown by FIG. 6, the latch boss 18 located on the partition piece 40 consequently makes its way into the latch groove between the two latch ribs 28,29 of the housing. A so-called "preliminary latch setting" of the partition piece 40 is attained, which in FIG. 6, in similar fashion to FIG. 5, is determined by the now lower situated height-level line 62. The partition piece 40 has moved with its lower longitudinal margin 45 closer to the lower slot end 55, thereby producing only a medium-sized vertical spacing 65.

In this preliminary latch setting 62 of FIGS. 6 and 7, it is of crucial importance that the dual-sided radial projections 46,47, as can be identified by dashed markings in FIG. 6, are already covered by wall parts 67,68 in the direction of the receiving space 31 of the socket housing 30. This prevents the partition piece 40 which has been brought into the preliminary latch setting 62 from withdrawing again axially in the opposite direction to the plug-in arrow 17 of FIG. 2. The partition piece 40 is therefore secured in its axial position also. In FIG. 6, the contours of a portion 70 which is provided on the mating-contact part 21 according to FIG. 2 and is here configured in the shape of a box are simultaneously indicated. As is discernible from the dashed marking in FIG. 6, the inserted regions of the radial projections 46,47 do not yet in the preliminary latch setting constrict the housing chambers 37. This means that the previously described axial insertion motion 24 of the contact parts 21, according to FIG. 2, into the axial position 21' of the mating-contact parts at the end of the chamber, which axial position is visible from FIG. 7 and is shown in dash-dot representation, is readily possible. It is of crucial importance that the partition piece is secured, including in its transverse mobility 19, by virtue of the latch engagement at 18,28,29. A prefitted structural unit 60, which is discernible from FIGS. 6 and 7, is obtained, which can be marketed by the manufacturer as a ready-made commercial product.

As can be seen with reference to FIGS. 6 and 7, this prepared structural unit 60 can now be equipped by the purchaser with the desired mating-contact parts 21 and with the selected electric leads 22 which are connected thereto. To this end, the mating-contact part 21 is brought into its axial end position 21', which is visible from FIG. 7 and is shown in dash-dot representation and which is fixed in the direction of the coupling end 69 of the housing 30 by stops in the region of the base wall 32. In this end position, which is shown in solid lines in FIG. 1, resilient tongues 25 which are provided on the contact part grip behind undercut run-up slopes 58 located on the inner face of the longitudinally profiled housing chamber 37. The axial position of the contact parts 21 relative to the rear end 39 of the housing 30 is thereby fixed. Above and below the openings 35 in the base wall 32, which openings have already been mentioned for the reception of the plug pins 23, smaller openings 71 are provided, as can best be seen from FIG. 3. These openings 71 are formed when tools are inserted into a molding die used in the injection-molding of the housing 30, in order to produce inside the housing chambers 37 the aforementioned undercuts in the run-up slopes 58. Onto the electric lead 22, in the region of the mating-contact part 21, there is placed a sealing ring 26, which, according to FIG. 1, seals the clear aperture of the housing chamber 37 against the rear end 39 of the socket housing 30.

Figure 8:
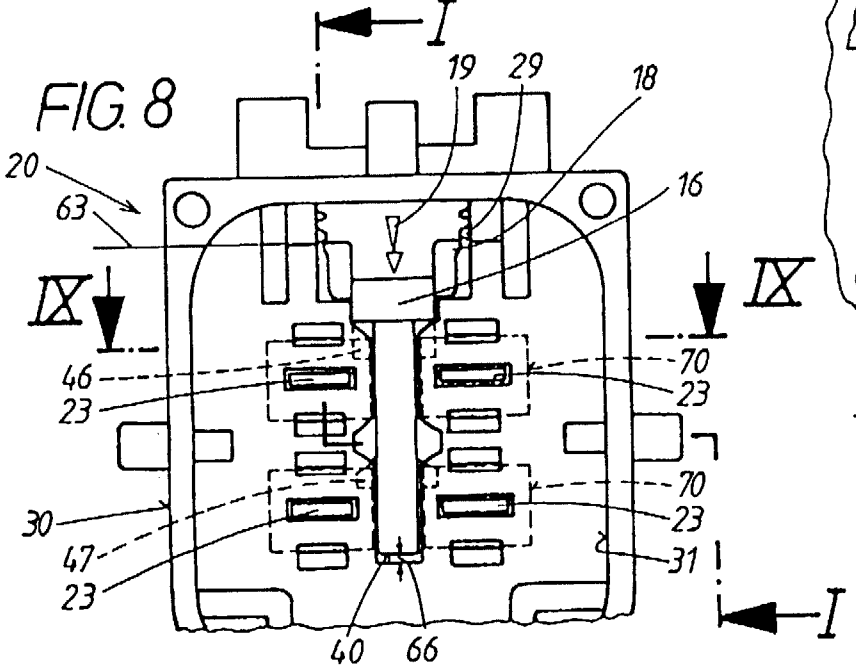

As a result of a further transverse displacement 19 of the partition piece 40, an end latch setting which is visible from FIGS. 8 and 9 is finally attained, as is illustrated from FIG. 8 by a height-level line 63. As the material has become deformed, the latch boss 18 has made its way below the second latch rib 29 of the housing. Only a minimal vertical spacing 66 is left between the lower longitudinal margin 45 of the partition piece 40 and the lower slot end 55 of the recess 50. As is discernible by virtue of the dashed markings in FIG. 8, the dual-sided radial projections 46,47 of the partition piece 40 have now passed behind the box portions 70 of the contact parts 21 and there back-grip radial shoulders 27, as can best be seen from FIG. 9. The contact parts 21 are now secured in their axial end position.

In the end latch setting of the partition piece 40, the aforementioned axial control pin 16 also assumes in the receiving space 31 a defined vertical position, which is axially aligned with a complementary control notch (not discernible in detail) in the housing 13 of the other connecting part 10 of FIG. 1. This indicates that all component parts are properly positioned. Only if this is the case can the two connecting parts 10,20 be fitted axially one inside the other. Otherwise, if the preliminary latch setting 62 according to FIG. 6 were still to obtain, for example, the front end of the control pin 16 would not yet be aligned with the aforementioned control notch in the other connecting part 10, thereby making it impossible for the two connecting parts 10,20 to be fitted axially one inside the other.

We claim:

1. An electrical connecting part (20,10) of a two-part plug-and-socket connection, having a plug housing (13) and a socket housing (30), each housing having a coupling end (69), the coupling ends having mutually complimentary coupling portions (14,36), the socket housing (30) having at least two axial chambers lying next to each other in pairs; an axial partition (38) disposed between said chambers adjacent an axial recess which opens toward the coupling end (69) of the socket housing (30), electrical contact parts (21) coupled to respective leads (22) and sized for insertion into the axial chambers (37) up to a defined end position (1') and into the coupling portion (36) of the socket housing (30), the contact parts having radial shoulders, and a slide (40) sized for insertion into the axial recess to a position adjacent the axial partition, the slide having radial projections serving as blocking elements, the slide being movable within the socket housing (30), said slide having a wall part and a U-shaped guide rail on the upper longitudinal margin of the wale part, and latch fastenings disposed radially on both sides of the guide rail, said latch fastenings include blocking elements and is transversely movable (19) between a preliminary latch setting (62) and an end latch setting (63) within the housing, wherein in the end latch setting, the blocking elements engage the radial shoulders (27) of the contact parts (21) so as to lock the contact parts (21) in an axial end position (21') within the axial chambers 37 of the socket housing (30), and wherein in the preliminary latch setting (62), the blocking elements allow for axial insertion of the contact parts (21) into the axial chambers of the socket housing (30).

2. The connecting part as claimed in claim 1, wherein the latch-effecting transverse motion (19) of the slide within the housing (30) takes place in a vertical direction of the axial recess (50, perpendicular to the plug-in direction and wherein the height (54) of the axial recess (50) extends from the setting (61) of the slide in its plug-in fitting, beyond its preliminary latch setting (62), at least up to the end latch setting (63).

3. The connecting part as claimed in claim 1 wherein the axial recess (50) guides the slide in its transverse motion (19).

4. The connecting part as claimed in claim 1, wherein in the preliminary latch setting (62), the radial projections (46,47) of the slide, in the direction of the coupling end (69) of the housing (30), are covered by wall parts (67,68) bordering the aperture profile of the axial recess (50).

5. The connecting part as claimed in claim 1, wherein the axial recess (50) extends between a plurality of housing chamber pairs (37) of the housing (30), which housing chambers are situated one above the other in pairs, and wherein the slide has a plurality of radial projections (46,47) lying vertically staggered relative to one another, which, in the end latch setting (63), engage the radial shoulders (27) of a plurality of contact parts (21) within the corresponding housing chambers (37).

6. The connecting part as claimed in claim 1, wherein the latch fastenings (18) are disposed on the slide (40) on U-shaped guide rail, (42) and faces away from the direction of the latch-effecting transverse motion (19) of the slide.

* * * * *